US008096254B1

(12) United States Patent
Bauer et al.

(10) Patent No.: US 8,096,254 B1
(45) Date of Patent: Jan. 17, 2012

(54) UNMANNED VEHICLE LAUNCH AND RECOVERY SYSTEM

(75) Inventors: Eric Bauer, San Diego, CA (US); Kelly Krueger, La Mesa, CA (US); Paul Ferrell, San Diego, CA (US); James Arthur, El Cajon, CA (US); Ryan Davis, Davenport, IA (US)

(73) Assignee: The United States of American as represented by the Secretary of the Navy, Washington, DC (US)

( * ) Notice: Subject to any disclaimer, the term of this patent is extended or adjusted under 35 U.S.C. 154(b) by 89 days.

(21) Appl. No.: 12/748,530

(22) Filed: Mar. 29, 2010

(51) Int. Cl.
*B63B 35/40* (2006.01)

(52) U.S. Cl. ..... 114/259; 114/373

(58) Field of Classification Search ..... 114/71, 114/72, 205, 244, 258, 259, 365, 366, 373, 114/375, 260, 263
See application file for complete search history.

(56) References Cited

U.S. PATENT DOCUMENTS

| | | | | |
|---|---|---|---|---|
| 1,111,836 | A * | 9/1914 | Johnson et al. | 114/366 |
| 1,587,979 | A * | 6/1926 | Nelson | 114/366 |
| 5,253,605 | A | 10/1993 | Collins | |
| 6,698,376 | B2 | 3/2004 | Delahousse | |
| 6,779,475 | B1 | 8/2004 | Crane | |
| 6,874,729 | B1 | 4/2005 | McDonnell | |
| 7,028,627 | B2 | 4/2006 | Bouchaud | |
| 7,097,137 | B2 | 8/2006 | McDonnell | |
| 7,114,680 | B2 | 10/2006 | Dennis | |
| 7,156,036 | B2 | 1/2007 | Seiple | |
| 7,347,157 | B2 | 3/2008 | Seiple | |
| 7,350,475 | B2 | 4/2008 | Borgwarth | |

* cited by examiner

*Primary Examiner* — Lars A Olson
(74) *Attorney, Agent, or Firm* — Kyle Eppele; Stephen E. Baldwin

(57) ABSTRACT

In one preferred embodiment, the present invention provides a system for launching and recovering one or more unmanned, underwater vehicles. The system includes a surface vessel having a generally low waterline for transporting, launching and recovering the unmanned vehicles. The system provides the ability to transport, launch and recover unmanned vehicles from either the port or starboard sides of the surface vessel, utilizing an A-frame hoist assembly which can be moved laterally in a controlled manner between the port and starboard sides of the surface vessel for lifting the unmanned vehicles, and which can be pivoted in a controlled manner to provide the launch and recovery operations.

14 Claims, 12 Drawing Sheets

FIG. 10
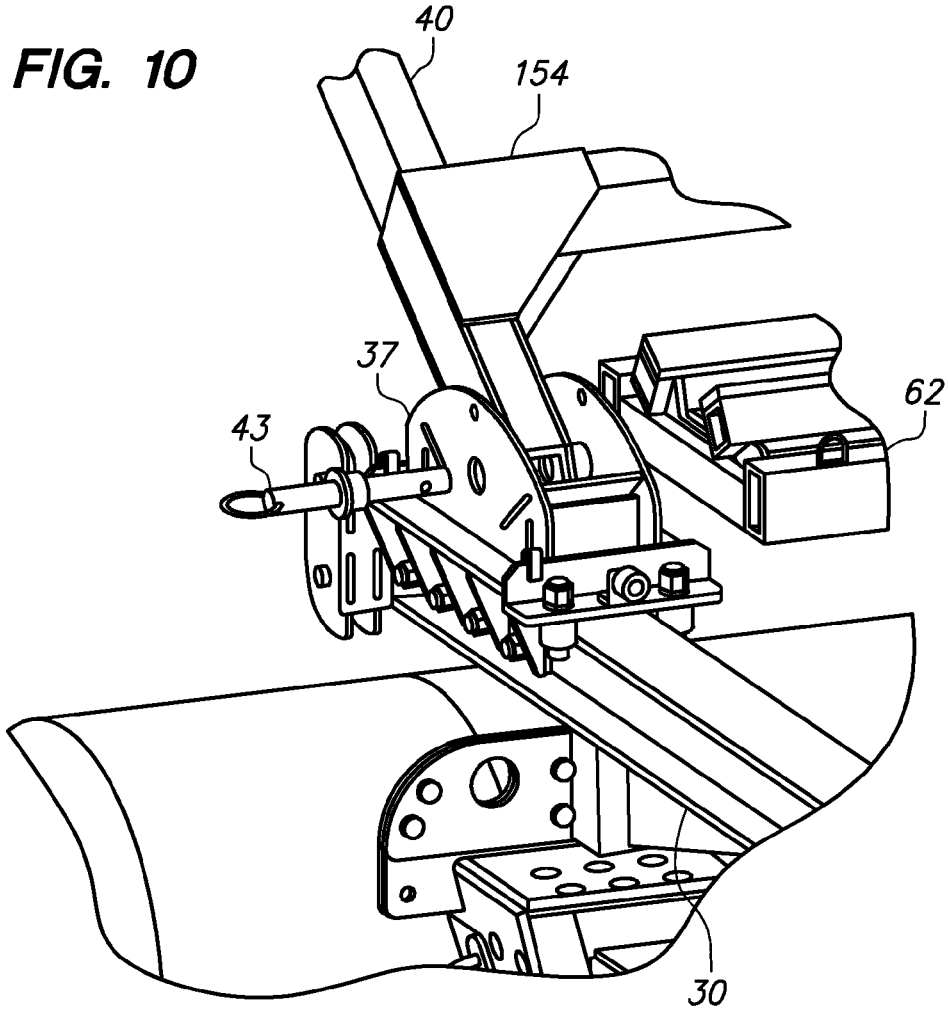
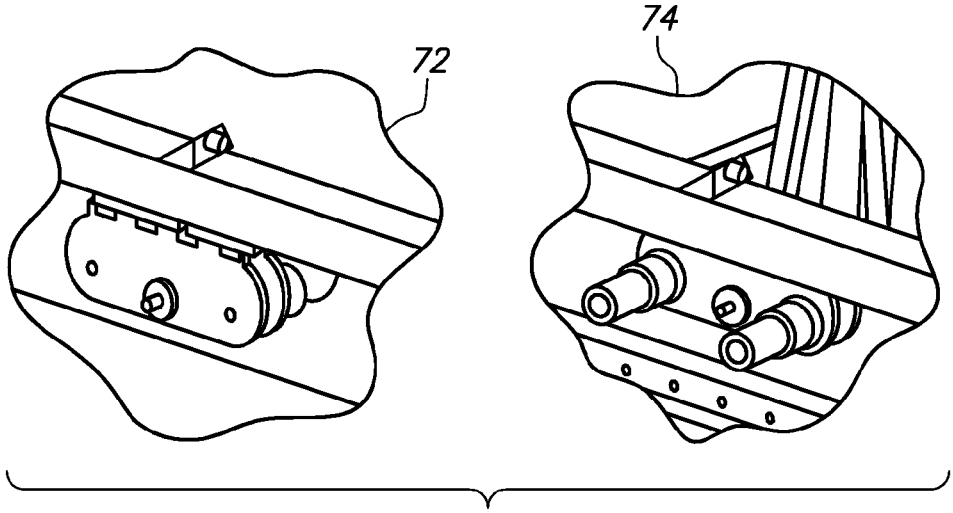
FIG. 11

UNMANNED VEHICLE LAUNCH AND RECOVERY SYSTEM

FEDERALLY-SPONSORED RESEARCH AND DEVELOPMENT

This invention (Navy Case No. 100194) is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-2778; email T2@spawar.navy.mil.

BACKGROUND OF THE INVENTION

The present invention relates to the launching and recovery of unmanned vehicles, and more specifically to an unmanned, underwater vehicle launch and recovery system. Launching and recovering unmanned vehicles from ships at sea is typically performed with hydraulically powered cranes or stern gate ramps, and from significantly large vessels. It would be desirable to provide a system which allows launch and recovery of such unmanned vehicles from relatively smaller surface vessels, thus reducing the expenses of operations.

SUMMARY

In one preferred embodiment, the present invention provides a system for launching and recovering one or more unmanned, underwater vehicles. The system includes a surface vessel having a generally low waterline for transporting, launching and recovering the unmanned vehicles. The system provides the ability to transport, launch and recover unmanned vehicles from either the port or starboard sides of the surface vessel, utilizing an A-frame hoist assembly which can be moved laterally in a controlled manner between the port and starboard sides of the surface vessel for lifting the unmanned vehicles, and which can be pivoted in a controlled manner to provide the launch and recovery operations.

BRIEF DESCRIPTION OF THE DRAWINGS

Throughout the several views, like elements are referenced using like references:

FIG. 10 shows a perspective view of the mounting of a trolley, A-frame and I-beam members.

FIG. 11 shows views of aft and forward trolley stops.

DETAILED DESCRIPTION OF THE EMBODIMENTS

The present invention relates to an unmanned vehicle launch and recovery system. Unmanned underwater vehicles (UUV) include remotely operated vehicles (which are controlled remotely by an operator), and autonomous underwater vehicles, which can operate independently of user input. The market for such UUVs includes scientific applications (including universities, environmental, hydrographic and other research agencies), commercial offshore applications (fishery, gas, oil and the like), and military applications (such as littoral, mine countermeasures and battle space preparation).

In one embodiment, the launch and recovery system 10 of the present invention is for use with a surface vessel which has a generally low waterline, such as a rigid-inflatable boat (RIB), a rigid-hulled inflatable boat (RHIB), or other similar types of surface vessels, with generally solid hull structures. Such RHIB-type surface vessels are typically in the range of 11 meters in length, with generally low waterlines, making them particularly suitable for the launch and recovery system of the present invention. The system 10 is designed so that the unmanned vehicles are launched and recovered from the port or starboard side of the vessel.

Figure 1:
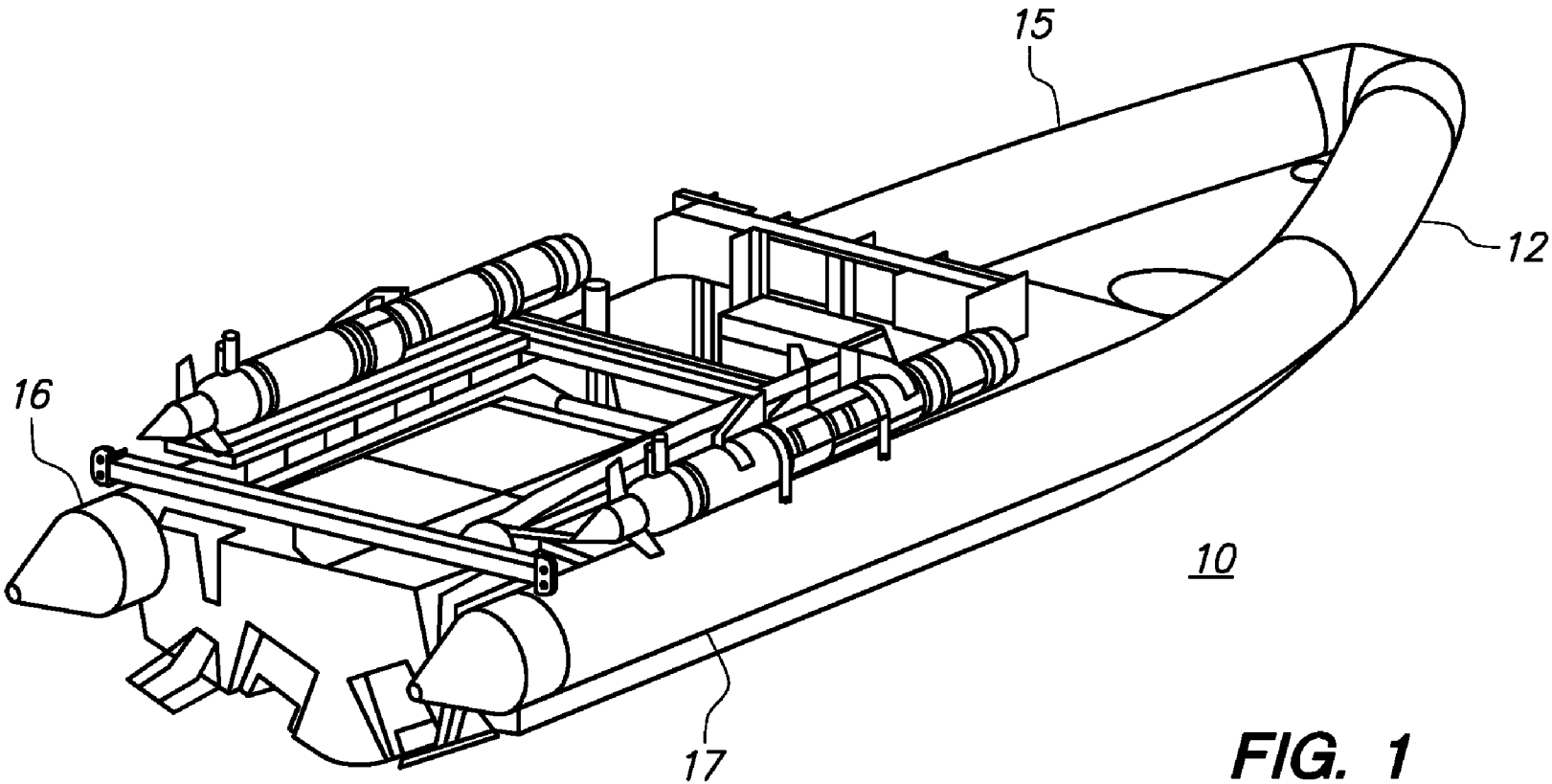
FIG. 1 shows a perspective view of an unmanned underwater vehicle launch and recovery system (UUVLRS) of the present invention.

FIG. 1 shows a perspective view of a launch and recovery system 10 according to one embodiment of the present invention. The surface vessel 12 shown in FIG. 1 is a RHIB type surface vessel, but it should be understood that many other types of surface vessels could be utilized with the present invention. The launch and recovery platform 16 is mounted on the aft section of surface vessel 12. The platform 16 has the ability to launch and recover unmanned vehicles from the either the port side 15 or starboard side 17 of the surface vessel 12.

Figure 2:
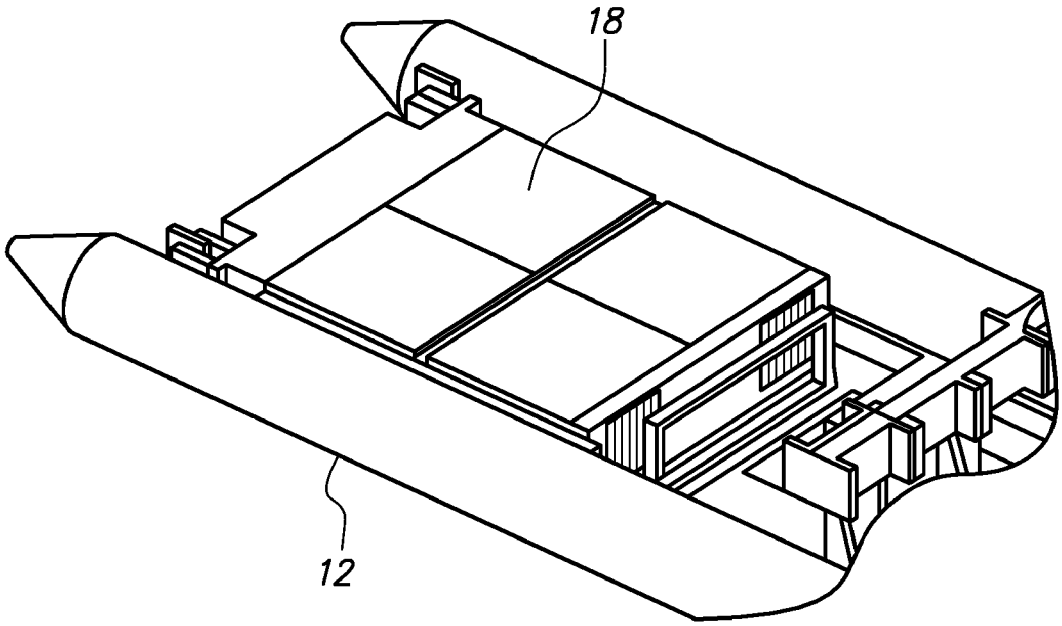
FIG. 2 shows a perspective view of the aft payload base of a surface vessel, which forms a portion of the system of FIG. 1.

FIG. 2 shows a perspective view of a payload system installation base configuration for the aft section of surface vessel 12 of FIG. 1. The components which form platform 16 of FIG. 1 can be mounted individually to the aft section 18 shown in FIG. 2, or mounted as a platform configuration 16, as desired.

Figure 3:
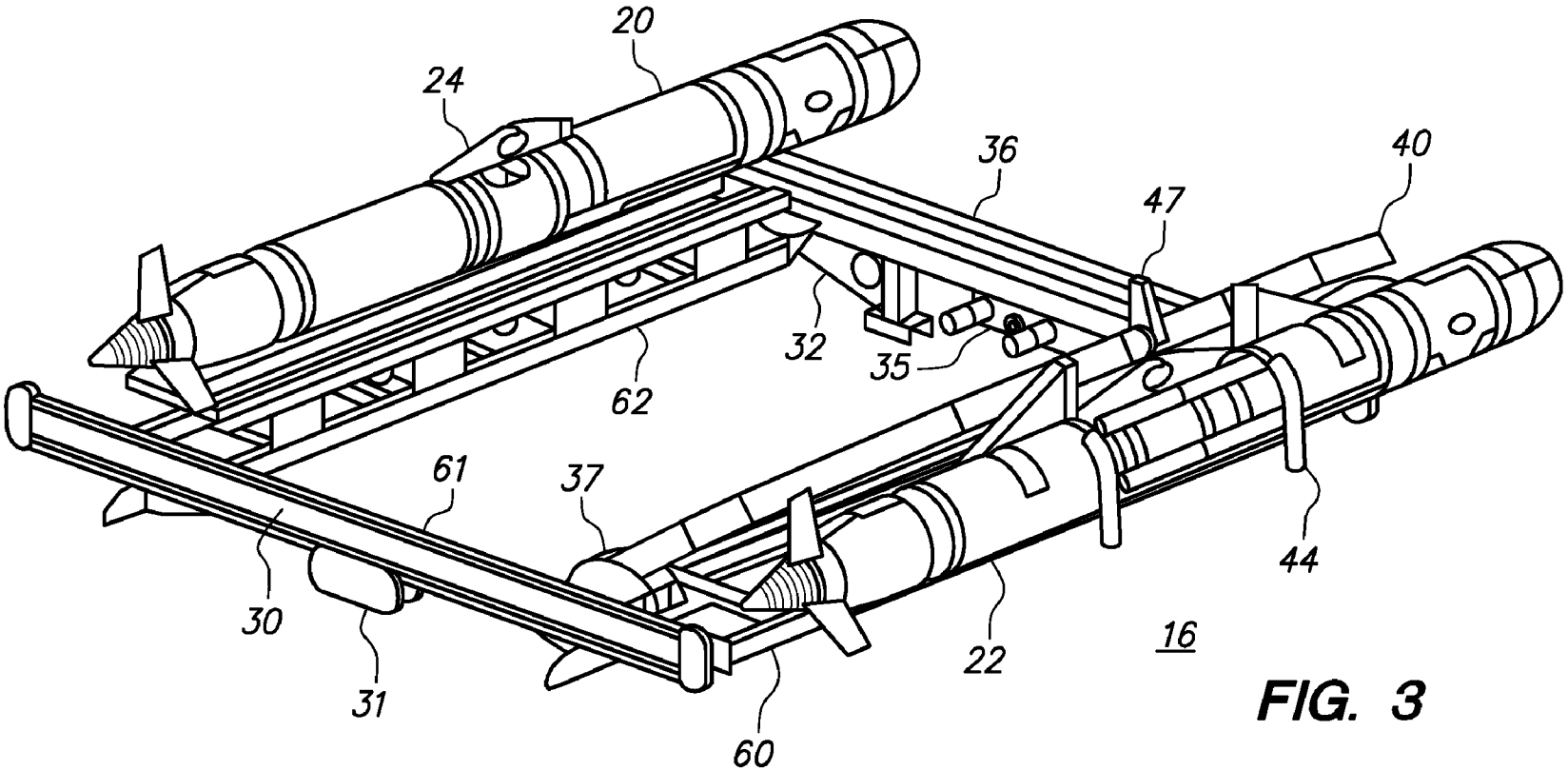
FIG. 3 shows a platform configuration of the launch and recovery system.

FIG. 3 shows a perspective view of the launch and recovery platform 16, which forms a part of the system 10 shown in FIG. 1. Two unmanned vehicles 20, 22 are shown in FIG. 3. Various types of unmanned vehicles can be utilized with the present invention, such as unmanned, underwater vehicles and unmanned, surface vehicles.

Suitable type of unmanned vehicles are shown in FIG. 3, which are generally torpedo shaped unmanned, underwater vehicles 20, 22. Such UUVs are available from a variety of manufacturers, for instance Hydroid, Inc. of Pocasset, Mass., which manufactures a variety of suitable UUVs under the brand name REMUS. Such vehicles can range in weight from 80 pounds to over 2000 pounds, and can be utilized for many different purposes.

The vehicles 20, 22 shown in FIG. 3 have a strong back 24, which is an eyelet brace located near the center of gravity for the vehicles, to provide stability during launch and recovery lifting operations. The vehicles 20, 22 also typically have a front eye bolt (not shown), which an operator can utilize in launch and recovery operations.

In one embodiment, the Unmanned Vehicle Launch and Recovery System (UVL&R) 10 is designed to launch, recover and transport two unmanned vehicles. The perspective platform 16 shown in FIG. 3 includes two stainless steel I-beams 30, 32, an A frame hoist assembly 40, two trolleys 37, 39 (trolley 39 not seen in perspective FIG. 3), two chain drives 34, 36 (driven by motors 31, 35), a launch & recovery winch 42 (not seen in FIG. 3), two UV cradles 60, 62, and a recovery basket 44. Not shown in FIG. 3 are battery and electrical control boxes, as they are not believed necessary for an understanding of the operation of the system.

In a preferred embodiment, the I-beams 30, 32 serve as the structural foundation for the system 10. The trolleys 37, 39, which are attached to the I-beams 30, 32 and to the A-frame 40, move laterally along the top flange portions of the I-beams 30, 32 via a chain drive system of chain drives 34, 36. The chains are propelled by two electric motors 31, 35 positioned on each I-beam 30, 32, respectively. The trolleys 37, 39 support A-frame assembly 40 which can be positioned to controllably launch and recover an unmanned vehicle on the port or starboard side of the surface vessel 12 of FIG. 1.

The A-frame 40 includes an electric winch mechanism 42 (not seen in perspective FIG. 3) which controllably raises or lowers the selected vehicle 20 or 22. Two UUV cradles 60, 62, positioned on either side of the vessel, support the unmanned vehicles 20, 22 during transit, and each cradle includes shock mitigation features.

Figure 4:
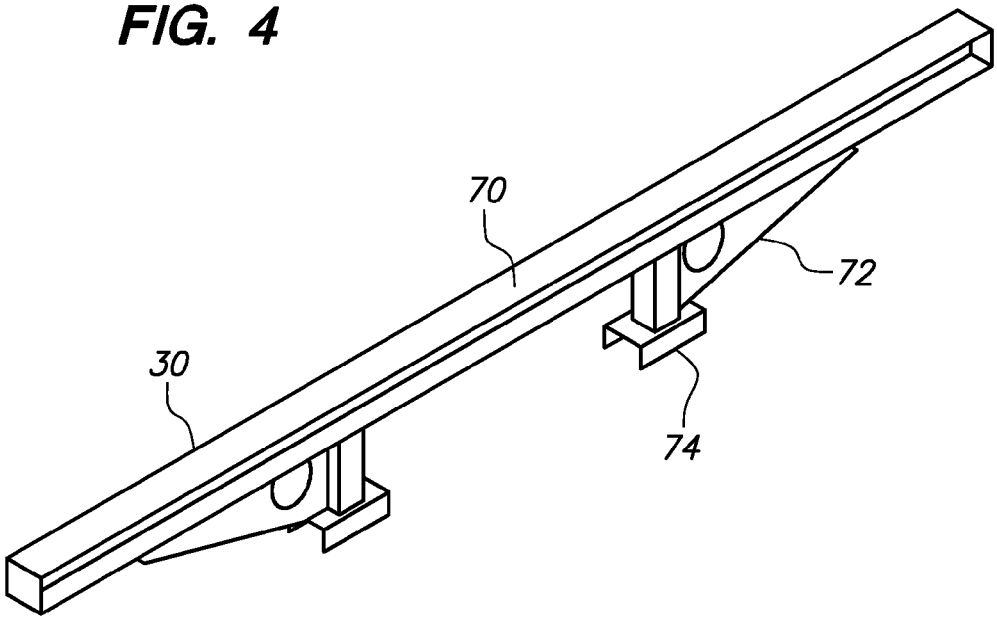
FIGS. 4 and 5 show forward and aft I-beam supports, respectively.
Figure 5:
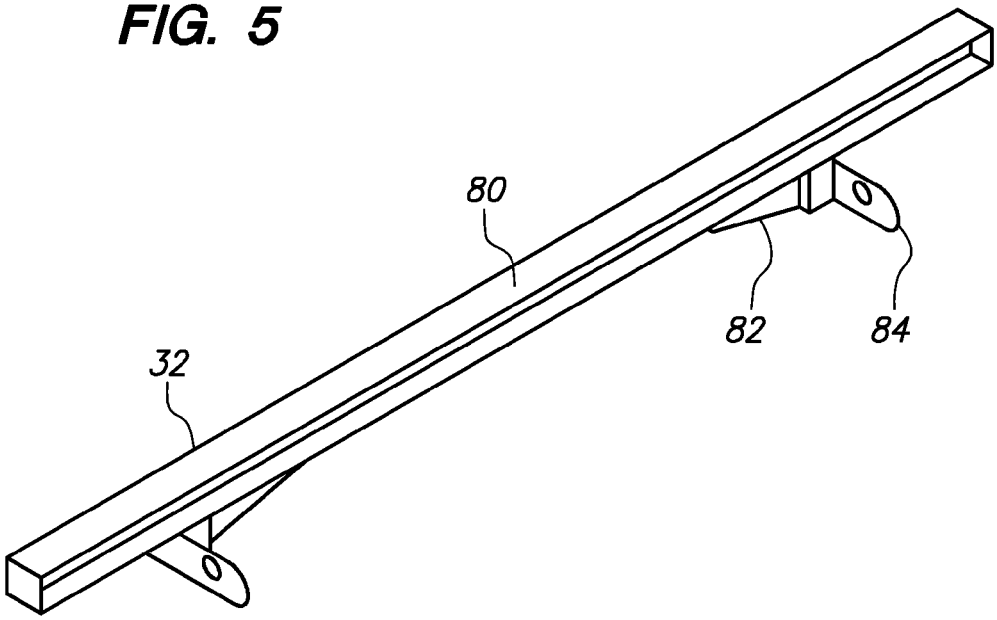

Referring now to FIGS. 4 and 5, the forward and aft I-beam support members 30, 32 are shown. In one embodiment, the I-beam members 30, 32 are made of stainless steel, with flanges 72, 82 for added support. The trolley assembly shown in FIG. 3 is mounted onto the top flange portions 70, 80 of I-beam members 30, 32, as will be described in more detail. Another embodiment of the I-beam assembly members could be made of titanium for additional support. The I-beam members 30, 32 are typically bolted to the deck portion of the surface vessel 12 via brackets 74, 84.

Figure 6:
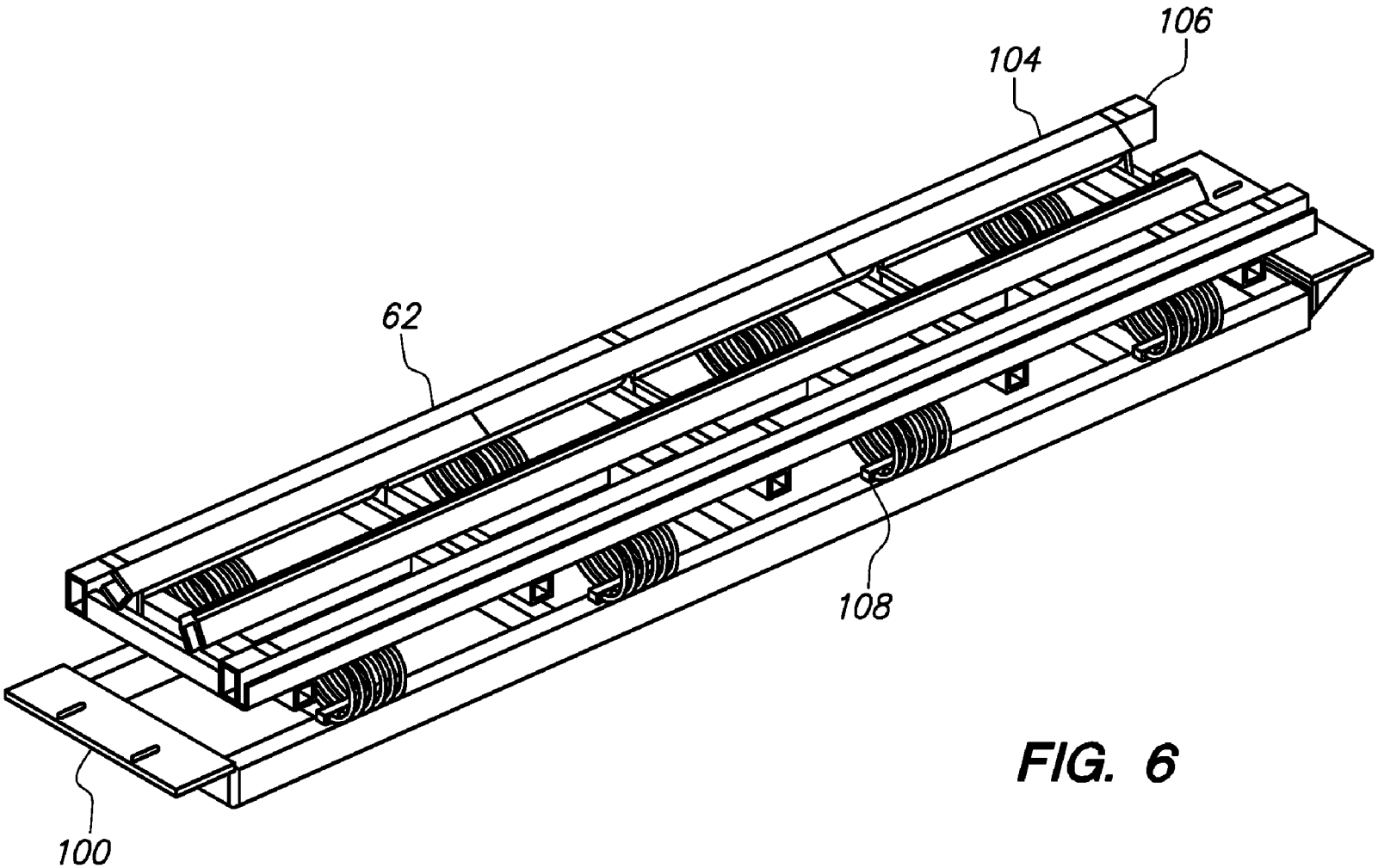
FIG. 6 shows a cradle frame interface assembly.

The cradle assembly 62 shown in FIG. 6 provides support for the unmanned vehicles during transport, and are positioned lengthwise on either side 15, 17 of the surface vessel 12 of FIG. 1. In one embodiment, the cradle assembly 62 is mounted to the I-beam support members of FIGS. 5 and 6. The cradle assembly 62 as shown in FIG. 6 is designed for supporting a torpedo-shaped unmanned vehicle, but could be designed for other types of vehicles, as desired.

In FIG. 6, the cradle assembly 62 includes a generally flat frame interface plate 100, which is typically bolted lengthwise to the I-beam support members 30, 32 of FIGS. 4 and 5. The frame interface 104 is formed lengths of several metal rectangular tubes (typically aluminum) 106 which are arranged along frame 104, as shown in FIG. 6. A respective cradle assembly is mounted lengthwise across the I-beam support assembly, near the respective port and starboard sides of the surface vessel, for supporting an unmanned vehicle. The cradle assembly 62 of FIG. 6 also includes wire rope isolators 108, which provide a shock mitigation feature for protecting the unmanned vehicles during the transportation, launch and recovery procedures. A UUV can be secured to the cradle via conventional straps (not shown) around the UUV and cradle assembly 62 during transportation.

Figure 7:
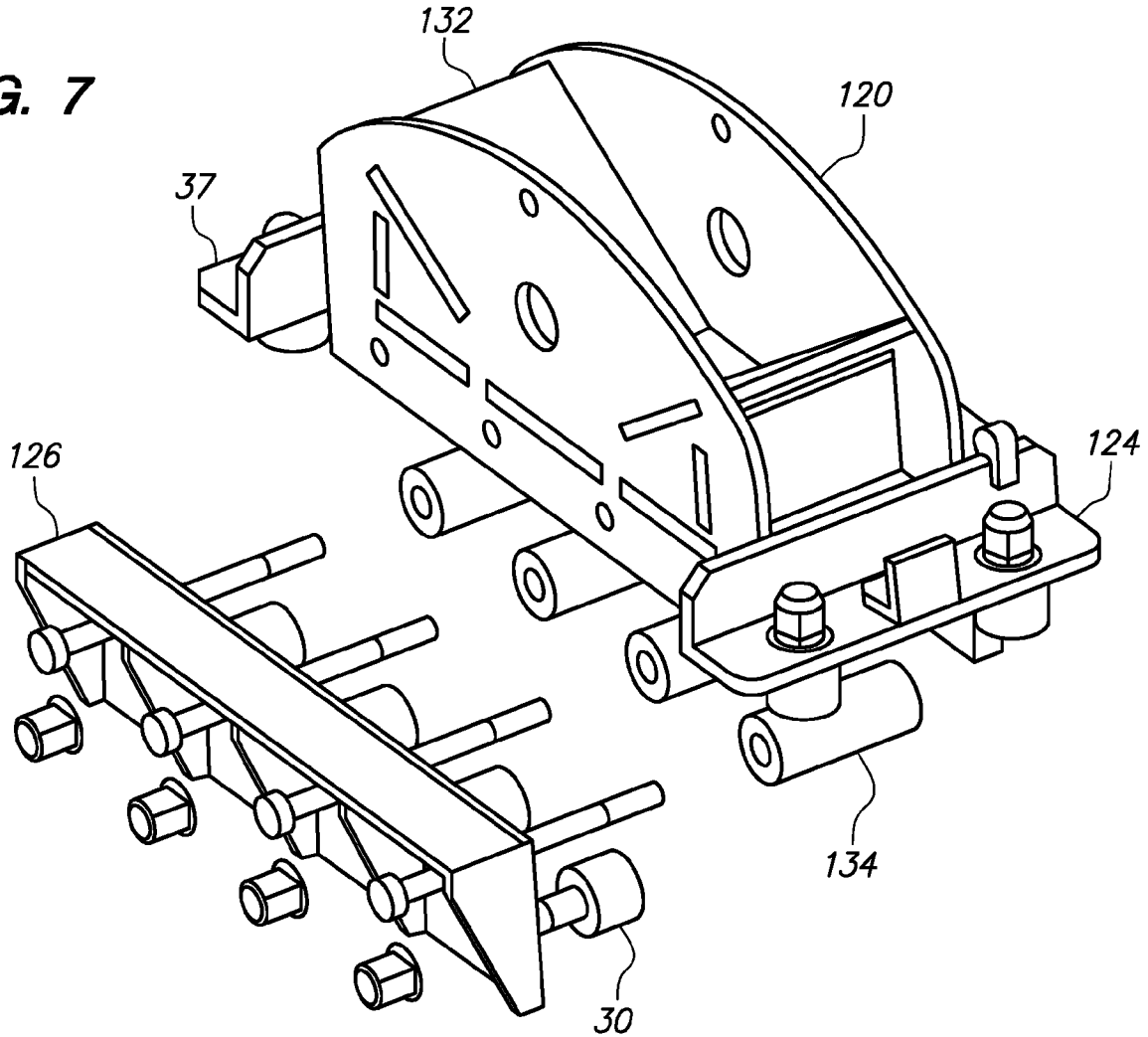
FIG. 7 shows an exploded view of a trolley assembly.

The trolley assembly component of the present system includes a pair of trolleys 37, 39, one of which (trolley 37) is shown in FIG. 7. Trolley 37 is mounted onto the top flange portion of the respective I-beam support member (FIGS. 4 and 5) in a sandwich configuration with plates 120, which are typically bolted together with brackets 124, 126, as shown, so that the rollers 130, 134 can effect controlled lateral movement along the respective I-beam member between the sides 15, 17 of surface vessel 12. Angled plates 132 provide a pivot stop for the pivoting of the A-frame hoist assembly 40.

Each trolley 37, 39 can be laterally moved between the port and starboard sides of the surface vessel 12 by using a chain drive (FIG. 3), where each chain drive is controlled by an electric motor, in one embodiment. This would allow controlled lateral movement of the trolley assembly along the I-beam assembly between the respective sides of the surface vessel.

Figure 8:
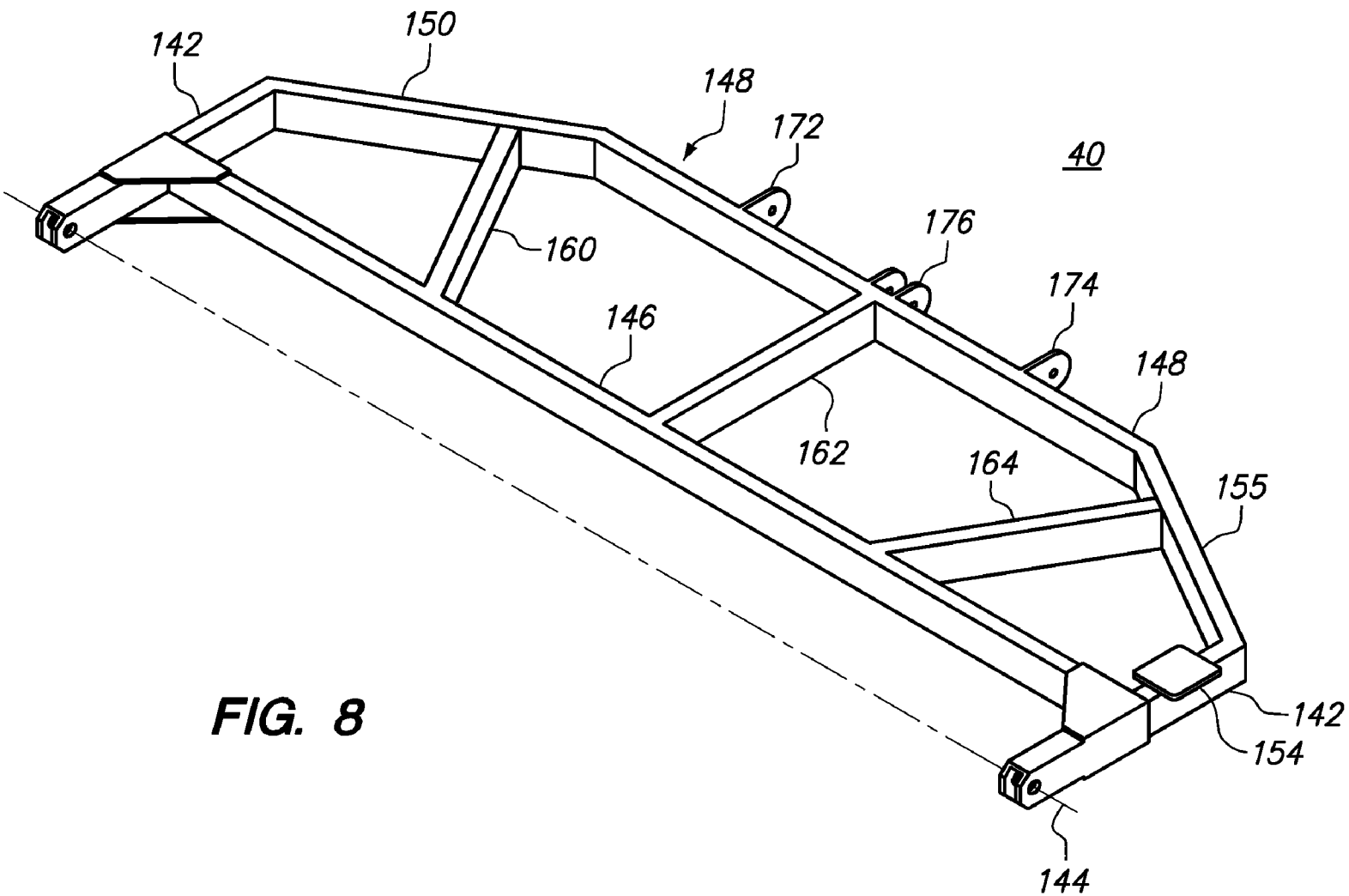
FIG. 8 shows a perspective view of an A-frame hoist assembly.

A perspective view of the A-frame hoist assembly 40 is shown in FIG. 8. The A-frame 40 is a generally planar structure and includes leg or base members 140, 142 connected to a top cross member 148 via spar members 150, 155, so that the A-frame 40 is in the form of a truncated letter "A". Lower cross member 146 is connected between leg members 140, 142 via flange or anchor brackets 154. Brace members 160, 162, 164 provide additional support for A-frame 40. Plate 170 is provided for a winch mechanism to allow for controlled lifting of an unmanned vehicle via pulleys, such as pulley 176. The winch mechanism could be mounted onto another member of A-frame 40, such as cross member 146. The recovery basket 44 of FIG. 3 can be connected to brackets 172, 174 of A-frame 40 in FIG. 8. The base or leg members 140, 142 form a pivot or trolley axis 144, as shown in FIG. 8. The leg members 140, 142 are connected to respective trolleys 37, 39, to allow the A-frame 40 to pivot about the trolley axis 144 in a controlled manner. This trolley axis pivoting assists in the launch and recovery operations.

As described above, the overall shape of hoist assembly 40 is in the shape of a truncated "A", so the assembly is characterized as an A-frame assembly. Other variations of a hoist assembly for a suitable lifting function are of course possible, such as a truss design or the like.

Figure 9:
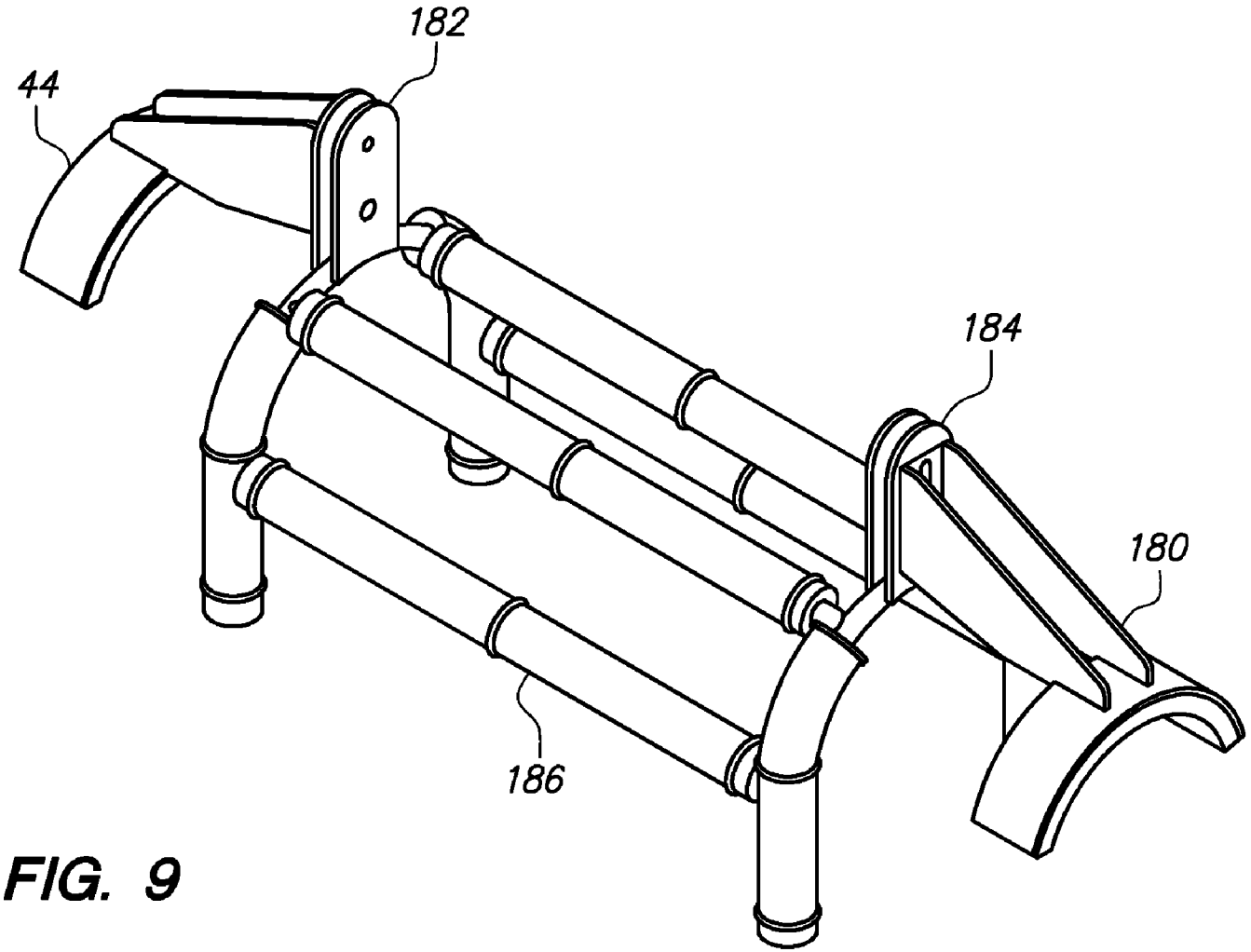
FIG. 9 shows a perspective view of a saddle recovery basket.

The saddle or recovery basket 44 shown in FIG. 9 is a U-shaped designed to contain a torpedo shaped unmanned vehicle, in conjunction with A-frame 40, in order to prevent or minimize actions such as rolling, pitching and yawing during transportation, launch and recovery. The recovery basket 44 is typically bolted via flanges 182, 184 to the top portion of A-frame hoist assembly 40, such as shown in FIG. 8. Other variations of the recovery basket are possible.

In the embodiments shown, the unmanned vehicle is generally torpedo shaped, but could be a vehicle of various other types of shapes to be utilized for launch and recovery. In FIG. 9, saddle 44 is generally U-shaped, formed of aluminum tubing 186, with end brackets 180 providing the desired containment of a torpedo shaped UUV.

It is apparent that the recovery basket 44 can be rotated or pivoted about the top cross member 148 of A-frame 40 shown in FIG. 8, to facilitate containment of either UUV 20 or 22 on the respective port or starboard sides 15, 17 of surface vessel 12 of FIG. 1.

A partial, perspective view of the A-frame hoist assembly 40 is also shown in FIG. 10, with the base member of A-frame 40 connected to the trolley 37 via pivot pin 43. A portion of cradle 62 is also shown. It will be understood that when the A-frame assembly is mounted onto the trolley assembly, the pair of trolleys form a trolley axis 144 (FIG. 8) with the base of the A-frame assembly, and that the A-frame hoist assembly is pivotable about the trolley axis 144 during operation of the launch and recovery system 10.

In FIG. 10, the A-frame 40 is mounted within trolley 73 via pin 43, so that A-frame 40 can pivot about the trolley axis 144 formed between trolleys 37, 39 when mounted on the I-beam assembly, including I-beams 30, 36. The trolley assembly is controllably movable on the I-beam assembly between the respective port and starboard sides of the surface vessel, and the trolley axis 144 is laterally movable as well. Consequently, the A-frame 40 is also controllably movable between the same sides of the surface vessel. In addition, it will be appreciated that the A-frame 40 can also be controllably pivoted about the trolley axis 144 for the launching and recovery operations.

FIG. 11 shows a perspective view of the aft and forward trolley stops 72, 74, which when attached to a respective I-beam member 30, 32, provide a stop function for the lateral movement of the respective trolleys 37, 40, which is useful in the launch and recovery operations.

Figure 12:
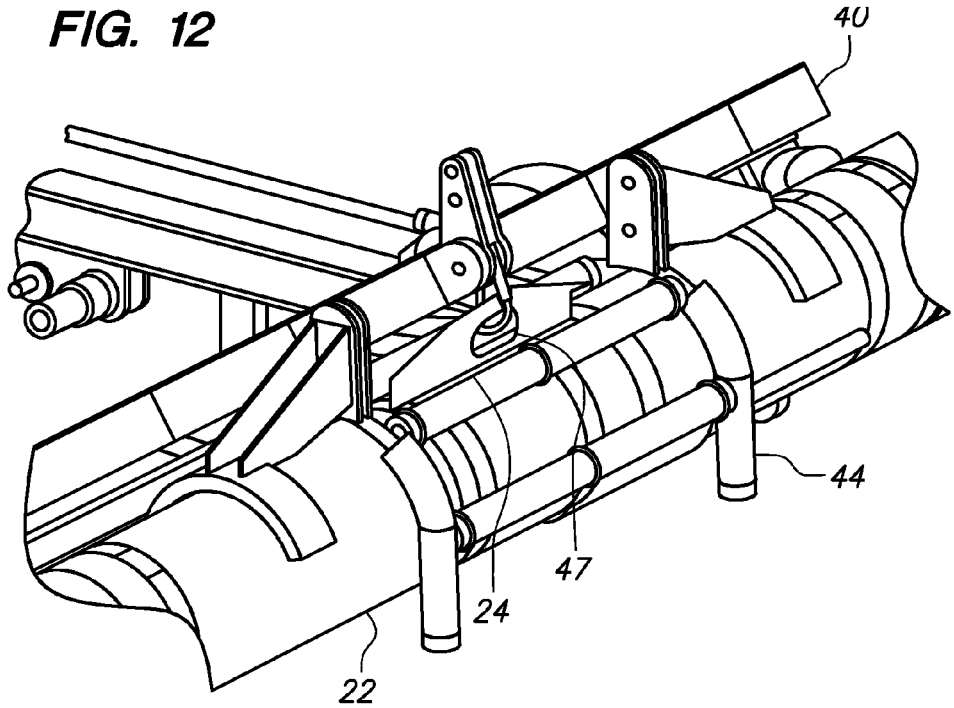
FIG. 12 shows a view of an UUV in a saddle recovery basket.

FIG. 12 shows a perspective view of a UUV 22 contained within the saddle recovery basket 44. The recovery basket 44 is connected to the A-frame 40 via brackets 182, 184, as previously described. The snap-hook 47 of winch cable 45 is connected to strong back 24 of UUV 22. When the winch mechanism is operated, the UUV 22 can be lifted for launch and recovery operations.

Figure 13:
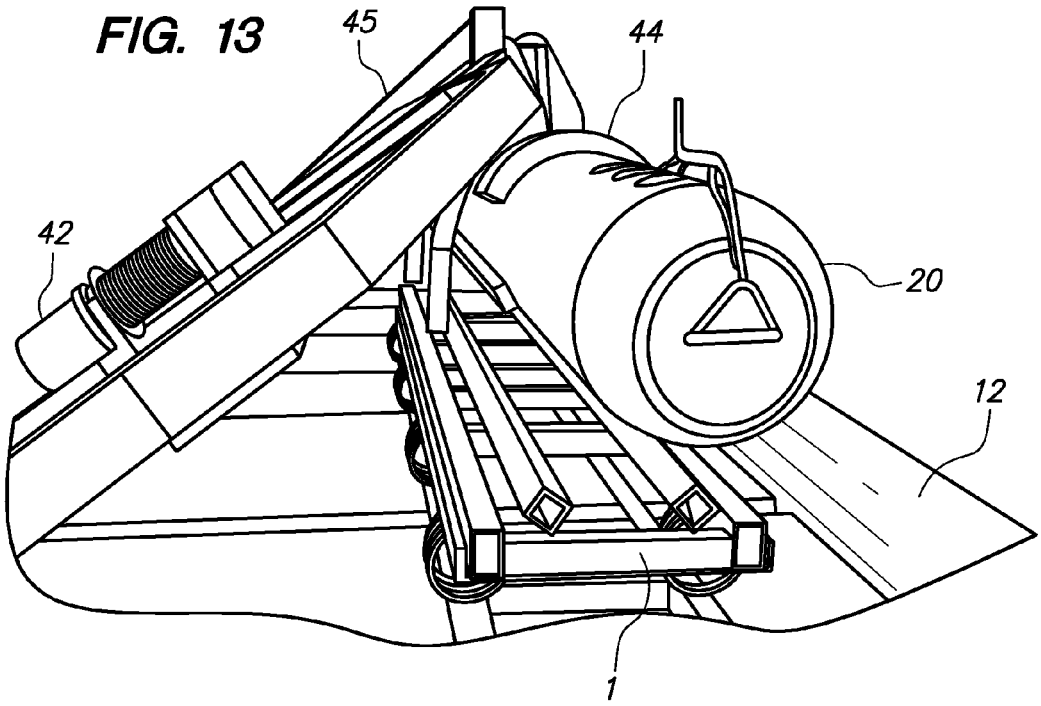
FIG. 13 shows a view of an UUV lifted to saddle receiver pads.

FIG. 13 shows a view of an UUV lifted to the saddle receiver pads of the saddle recovery basket 44, above the cradle 62. The UUV has been lifted by suitable control of winch 42, via winch cable 45, and the UUV is ready to be moved laterally over the port side of surface vessel 12.

Figure 14:
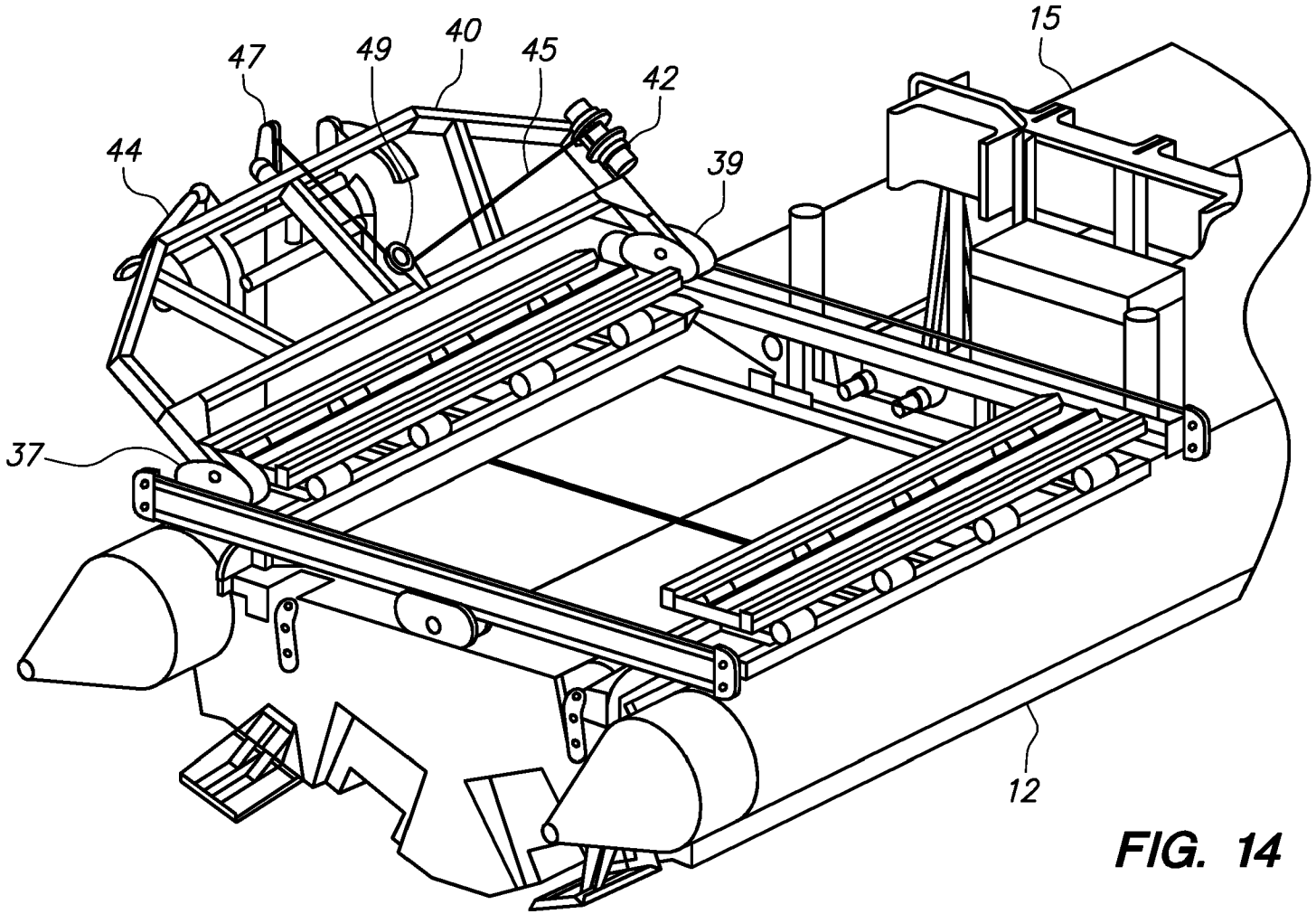
FIG. 14 shows an aft quarter view of the system with the A-frame extended over the port side of the surface vessel.

FIG. 14 shows a view of the launch and recovery system 10 with the A-frame extended over the port side of the surface vessel 12, with the UUV 22 contained with recovery basket 44, and ready to be deployed by control of the winch mechanism 42 via winch cable 45. It will be appreciated that the A-frame 40 can be moved laterally in a controlled manner between the sides of the surface vessel 12, and that the A-frame 40 can be pivoted about the movable trolley axis 144 to effect launch and recovery of a UUV. It should also be apparent when comparing the platform 16 in FIG. 3 and the view shown in FIG. 14 that the A-frame 40 has been laterally moved between the respective port and starboard sides of the surface vessel 12, and further that the recovery basket 44 has been rotated about the A-frame 40, to facilitate in the launch and recovery of a UUV from either side of the surface vessel 12.

Figure 15:
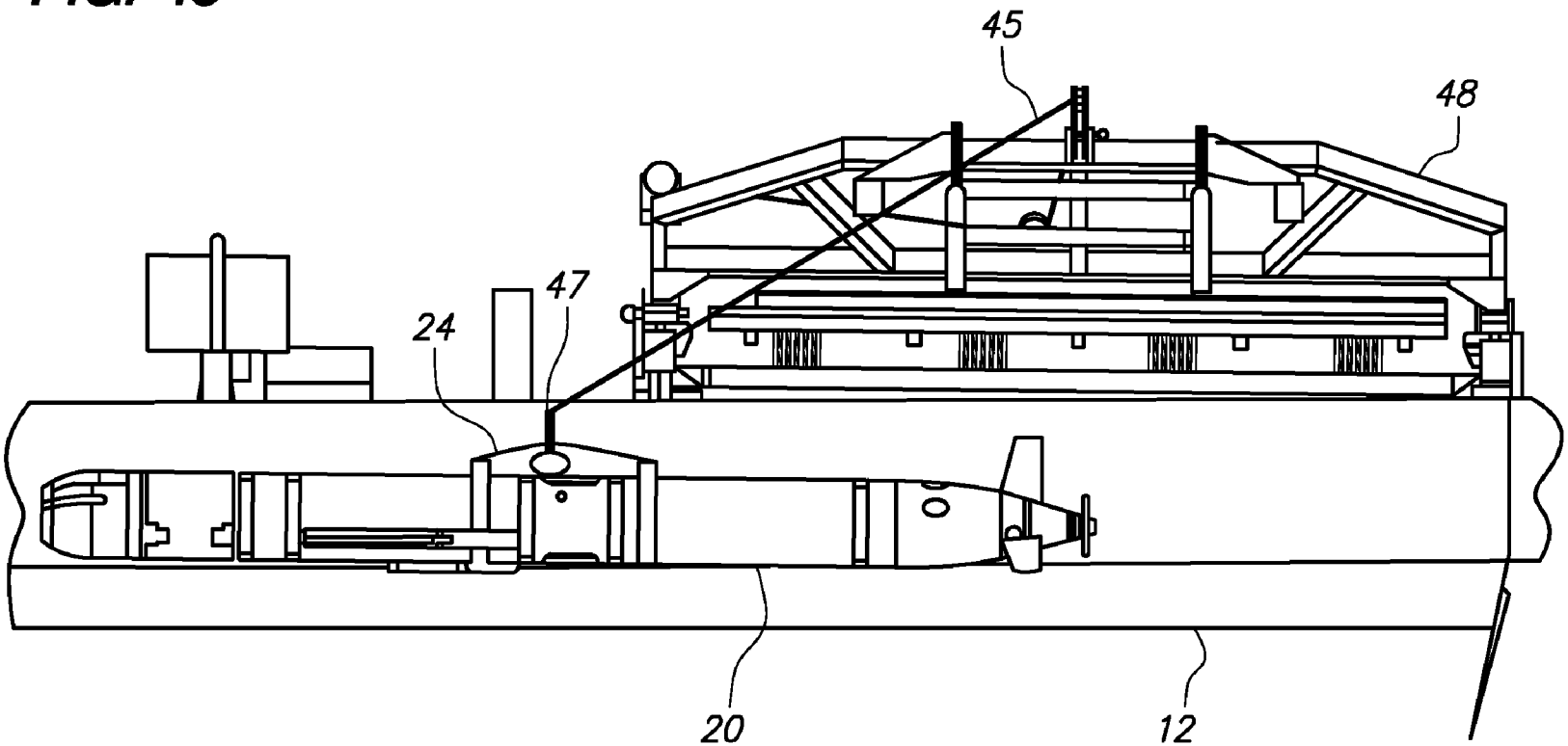
FIG. 15 shows a side view of the system with an UUV deployed.

FIG. 15 shows a side view of the system 10 with the UUV deployed over the port side of surface vessel 12. The winch cable 45 is attached to strong back 24 on UUV, and when snap-hook 47 is released, the UUV can then be launched for deployment purposes, or alternatively, when the snap-hook is engaged with strong back 24, the UUV can be recovered from deployment.

A suitable launching operation is described as follows, with the understanding that the electrical control aspects would be clearly understood by one of ordinary skill.

The A-frame saddle is positioned above the UUV to be launched. The winch cable is lowered and the snap-hook fitting is connected to the strong back located on the UUV. Using the winch, the UUV is lifted or raised until it is snug to the saddle receiver pads.

A restraining pole or tag line is connected to the front UUV eye bolt. The trolley is activated via electrical control and laterally moved so that the UUV is moved outboard of the RHIB surface vessel for launch. This typically requires running the trolley to the outward limit (the trolley stop).

The UUV is lowered into the water via the winch. Once the UUV is fully in the water and the winch line is slack, the UUV is unclipped from the winch line (the UUV is launched).

A suitable recovery operation is as follows:

The A-frame is positioned over water and winch cable is run out to enable access at water level. Generally, this requires running the trolley assembly to the outward limit. As the UUV orients into swells after surfacing, the RHIB driver sights the UUV on the surface and positions the RHIB behind UUV to approach at slow speed to the side of boat with the A-frame deployed. The UUV is slowly brought alongside RHIB. An operator connects restraining pole or tag line to the front UUV eye bolt. As the RHIB driver maintains a slow forward speed, an operator helps guide UUV to another operator to hook up the snap-hook to the strong back on the UUV.

The RHIB ceases forward motion as an operator raises the UUV with winch. Another operator continues to guide the UUV into the UUV saddle receiver until snug against the saddle receiver pads. The A-frame trolleys into position over the UUV cradle, and the winch is lowered to place the UUV on the cradle. The winch cable is disconnected from the UUV strong back and the UUV is secured to cradle assembly with cargo straps.

From the above description of the Unmanned Vehicle Launch and Recovery System, it is apparent that various techniques may be used for implementing the concepts of system 10 without departing from its scope. The described embodiments are to be considered in all respects as illustrative and not restrictive. It should also be understood that system 10 is not limited to the particular embodiments described herein, but is capable of many embodiments without departing from the scope of the claims.

What is claimed is:

1. An unmanned vehicle launch and recovery system comprising:

one or more unmanned vehicles;

a RHIB-type surface vessel having port and starboard sides and an aft deck portion for transporting, launching and recovering the unmanned vehicles, the surface vessel including an I-beam support assembly mounted laterally across the aft deck portion of the surface vessel, the I-beam assembly including a pair of spaced apart, generally parallel I-beam support members for providing structural foundation;

a movable trolley assembly mounted on the I-beam assembly, the trolley assembly including a pair of trolleys, each trolley mounted on and movable laterally along a respective I-beam between the port and starboard sides of the surface vessel, the pair of trolleys forming a laterally movable trolley axis;

a cradle-type assembly including a pair of cradles each mounted lengthwise along either respective side of the surface vessel for supporting a respective unmanned vehicle;

a pivotable A-frame hoist assembly having a base and including a vehicle recovery basket, the base of the A-frame attached lengthwise across the trolley assembly so that the A-frame is laterally moved when the trolley assembly is moved laterally toward a selected port or starboard side of the surface vessel to allow the A-frame to be controllably movable between the port and starboard sides of the vessel and controllably pivotable about the trolley axis for selective positioning over a selected one of the cradles;

the A-frame hoist assembly including a winch mechanism for lifting a selected unmanned vehicle from the selected cradle assembly to the vehicle recovery basket, the A-frame then being laterally movable further toward the selected port or starboard side of the vessel to allow clearance of the lifted unmanned vehicle over the respective side of the surface vessel, so that lowering of the selected unmanned vehicle by the winch mechanism over the selected side of the surface vessel to the surface allows for launching of the unmanned vehicle.

2. The system as in claim 1 for recovery of an unmanned vehicle, including the winch mechanism lifting an unmanned vehicle from the surface up and over a selected side of the vessel where the A-frame is controllably moved laterally over a respective cradle assembly on the respective side of the surface vessel, the winch mechanism lowering the selected unmanned vehicle onto the respective cradle assembly.

3. The system as in claim 2 wherein the A-frame assembly is generally planar.

4. The system as in claim 3 wherein the cradle assembly is mounted lengthwise on the I-beam assembly.

5. The system as in claim 4 wherein the cradle includes wire rope isolators for shock mitigation during transportation.

6. The system as in claim 5 wherein the recovery basket is rotatable about the A-frame hoist assembly for launch and recovery from either side of the surface vessel.

7. The system as in claim 6 wherein the unmanned vehicles are torpedo shaped and wherein the recovery basket is U-shaped to facilitate launch and recovery of the unmanned vehicles.

8. The system as in claim 7 wherein the I-beam support members each include a trolley stop.

9. The system as in claim 8 wherein the winch mechanism includes a snap hook fitting.

10. An unmanned vehicle launch and recovery system comprising:

one or more unmanned vehicles;

a RHIB-type surface vessel having port and starboard sides and an aft deck portion for transporting, launching and recovering the unmanned vehicles, the surface vessel including an I-beam support assembly mounted laterally across the aft deck portion of the surface vessel, the I-beam assembly including a pair of spaced apart, generally parallel I-beam support members for providing structural foundation;

a movable trolley assembly mounted on the I-beam assembly, the trolley assembly including a pair of trolleys, each trolley mounted on and movable laterally along a respective I-beam between the port and starboard sides of the surface vessel, the pair of trolleys forming a laterally movable trolley axis;

a cradle-type assembly including a pair of cradles each mounted lengthwise along either I-beam member for supporting a respective unmanned vehicle;

a generally planar hoist assembly having a base and including a vehicle recovery basket, the base of the hoist assembly attached lengthwise across the trolley assembly so that the hoist assembly is laterally moved when the trolley assembly is moved laterally toward a selected port or starboard side of the surface vessel to allow the hoist assembly to be controllably movable between the port and starboard sides of the vessel and controllably pivotable about the trolley axis for selective positioning over a selected one of the cradles;

the hoist assembly including a winch mechanism for lifting a selected unmanned vehicle from the selected cradle assembly to the vehicle recovery basket, the hoist assembly then being laterally movable further toward the selected port or starboard side of the vessel to allow clearance of the lifted unmanned vehicle over the respective side of the surface vessel, so that lowering of the selected unmanned vehicle by the winch mechanism over the selected side of the surface vessel to the surface allows for launching of the unmanned vehicle.

11. The system as in claim 10 for recovery of an unmanned vehicle, including the winch mechanism lifting an unmanned vehicle from the surface up and over a selected side of the vessel where the hoist assembly is controllably moved laterally over a respective cradle assembly on the respective side of the surface vessel, the winch mechanism lowering the selected unmanned vehicle onto the respective cradle assembly.

12. In an unmanned vehicle launch and recovery system for launch and recovering one or more unmanned vehicles and a RHIB-type surface vessel having port and starboard sides and an aft deck portion for transporting, launching and recovering the unmanned vehicles, a platform for mounting on the aft deck of the surface vessel comprising:

an I-beam support assembly mounted laterally across the aft deck portion of the surface vessel, the I-beam assembly including a pair of spaced apart, generally parallel I-beam support members for providing structural foundation;

a movable trolley assembly mounted on the I-beam assembly, the trolley assembly including a pair of trolleys, each trolley mounted on and movable laterally along a respective I-beam between the port and starboard sides of the surface vessel, the pair of trolleys forming a laterally movable trolley axis;

a cradle-type assembly including a pair of cradles each mounted lengthwise on the I-beam assembly along either respective side of the surface vessel for supporting a respective unmanned vehicle;

a pivotable A-frame hoist assembly having a base and including a vehicle recovery basket, the base of the A-frame attached lengthwise across the trolley assembly so that the A-frame is laterally moved when the trolley assembly is moved laterally toward a selected port or starboard side of the surface vessel to allow the A-frame to be controllably movable between the port and starboard sides of the vessel and controllably pivotable about the trolley axis for selective positioning over a selected one of the cradles;

the A-frame hoist assembly including a winch mechanism for lifting a selected unmanned vehicle from the selected cradle assembly to the vehicle recovery basket, the A-frame then being laterally movable further toward the selected port or starboard side of the vessel to allow clearance of the lifted unmanned vehicle over the respective side.

13. The platform as in claim 12 for recovery of an unmanned vehicle, including the winch mechanism lifting an unmanned vehicle from the surface up and over a selected side of the vessel where the A-frame is controllably moved laterally over a respective cradle assembly on the respective side of the surface vessel, the winch mechanism lowering the selected unmanned vehicle onto the respective cradle assembly.

14. An unmanned vehicle launch and recovery system comprising:

one or more unmanned vehicles;

a surface vessel having port and starboard sides and an aft deck portion disposed at a generally low vertical freeboard distance for transporting, launching and recovering the unmanned vehicles, the surface vessel including an I-beam support assembly mounted laterally across the aft deck portion of the surface vessel, the I-beam assembly including a pair of spaced apart, generally parallel I-beam support members for providing structural foundation;

a movable trolley assembly mounted on the I-beam assembly, the trolley assembly including a pair of trolleys, each trolley mounted on and movable laterally along a respective I-beam between the port and starboard sides of the surface vessel, the pair of trolleys forming a laterally movable trolley axis;

a cradle-type assembly including a pair of cradles each mounted lengthwise along either respective side of the surface vessel for supporting a respective unmanned vehicle;

a pivotable A-frame hoist assembly having a base and including a vehicle recovery basket, the base of the A-frame attached lengthwise across the trolley assembly so that the A-frame is laterally moved when the trolley assembly is moved laterally toward a selected port or starboard side of the surface vessel to allow the A-frame to be controllably movable between the port and starboard sides of the vessel and controllably pivotable about the trolley axis for selective positioning over a selected one of the cradles;

the A-frame hoist assembly including a winch mechanism for lifting a selected unmanned vehicle from the selected cradle assembly to the vehicle recovery basket, the A-frame then being laterally movable further toward the selected port or starboard side of the vessel to allow clearance of the lifted unmanned vehicle over the respective side of the surface vessel, so that lowering of the selected unmanned vehicle by the winch mechanism over the selected side of the surface vessel to the surface allows for launching of the unmanned vehicle.

* * * * *